US006393207B1

(12) United States Patent
Martin et al.

(10) Patent No.: US 6,393,207 B1
(45) Date of Patent: May 21, 2002

(54) ELECTRIC FIREPLACE WITH LIGHT RANDOMIZER, FILTER AND DIFFUSER SCREEN

(75) Inventors: Colm A. Martin, Monvvallet (IE); Donald R. Jamieson, Oakville (CA); Andy Luu, Mississauga (CA); David Diep, Toronto (CA); Lam Van Nguyen, Mississauga (CA)

(73) Assignee: CFM Majestic Inc., Mississauga (CA)

( * ) Notice: Subject to any disclaimer, the term of this patent is extended or adjusted under 35 U.S.C. 154(b) by 0 days.

(21) Appl. No.: 09/480,420

(22) Filed: Jan. 11, 2000

(Under 37 CFR 1.47)

Related U.S. Application Data

(60) Provisional application No. 60/115,918, filed on Jan. 14, 1999, and provisional application No. 60/125,637, filed on Mar. 22, 1999.

(51) Int. Cl.[7] ..... F24D 13/00

(52) U.S. Cl. ..... 392/348; 40/428; 40/431; 362/806

(58) Field of Search ..... 392/348; 40/428, 40/431; 431/125; 219/220; 362/806; 126/500

(56) References Cited

U.S. PATENT DOCUMENTS

| | | | |
|---|---|---|---|
| 1,514,552 | A | 11/1924 | McCormick |
| 1,531,171 | A | 3/1925 | Berry et al. |
| 1,590,083 | A | 6/1926 | Collins |
| 1,703,761 | A | 2/1929 | Berry |
| 1,719,622 | A | 7/1929 | Price |
| 1,809,164 | A | 6/1931 | Gritt |

FOREIGN PATENT DOCUMENTS

| | | |
|---|---|---|
| GB | 272362 | 6/1927 |
| GB | 371732 | 4/1932 |
| GB | 1024047 | 3/1966 |
| GB | 1088577 | 12/1967 |
| GB | 1164143 | 9/1969 |
| GB | 1372627 | 11/1974 |
| GB | 2 151 772 A | 4/1985 |
| GB | 2 180 927 A | 4/1987 |
| GB | 2 210 969 A | 6/1989 |
| GB | 2 222 000 A | 2/1990 |
| GB | 2 321 700 A | 5/1998 |
| WO | WO 97/41393 | 11/1997 |

(List continued on next page.)

*Primary Examiner*—John A. Jeffery
(74) *Attorney, Agent, or Firm*—Baniak Pine & Gannon

(57) ABSTRACT

In preferred aspects, the present invention comprises an electric fireplace designed to simulate a combustible fuel-burning fireplace. The electric fireplace comprises a housing having a top, a bottom, a back, and two sides. A simulated firebox having a top, a bottom, a back, and two sides is positioned within the fireplace housing. The firebox contains a log and ember set having one or more artificial logs positioned above an artificial bed of embers. The fireplace also comprises a mechanism for illuminating the underside of at least a portion of the artificial logs and a portion of the artificial bed of embers so as to create the illusion that the artificial logs and the artificial bed of embers are burning. The fireplace further comprises a flame simulation assembly for generating the appearance of simulated flames emanating from the artificial logs. The flame simulation assembly comprises a light source, a light randomizer, a light filter screen, and a light diffuser screen. The light randomizer comprises a rotating hollow cylinder having openings that permit light to pass through the cylinder. The light filter screen has an opaque area and a colored translucent area through which light from the light randomizer can pass on to the back of the light diffuser screen. The light diffuser screen has a partially translucent surface on which simulated flames are projected and are visible from the front of the fireplace.

27 Claims, 6 Drawing Sheets

U.S. PATENT DOCUMENTS

| | | | | |
|---|---|---|---|---|
| 1,824,388 | A | | 9/1931 | Birch |
| 1,843,279 | A | | 2/1932 | Gritt |
| 1,901,294 | A | | 3/1933 | Gritt et al. |
| 1,992,540 | A | | 2/1935 | Newton |
| 2,285,535 | A | | 6/1942 | Schlett |
| 2,684,244 | A | | 7/1954 | Brooks |
| RE24,399 | E | | 12/1957 | Brooks |
| 2,984,032 | A | | 5/1961 | Cornell |
| 3,321,859 | A | | 5/1967 | Moss |
| 3,395,475 | A | | 8/1968 | Moss |
| 3,395,476 | A | | 8/1968 | Moss et al. |
| 3,499,239 | A | | 3/1970 | Mungo |
| 3,526,984 | A | | 9/1970 | Nielsen et al. |
| 3,603,013 | A | | 9/1971 | Reed et al. |
| 3,699,697 | A | | 10/1972 | Painton |
| 3,742,189 | A | | 6/1973 | Conroy et al. |
| 4,549,523 | A | | 10/1985 | Hirauchi et al. |
| 4,890,600 | A | | 1/1990 | Meyers |
| 4,965,707 | A | | 10/1990 | Butterfield |
| 5,195,820 | A | | 3/1993 | Rehberg |
| 5,642,580 | A | | 7/1997 | Hess et al. |
| 6,162,047 | A | * | 12/2000 | Hess ..... 431/125 |

* cited by examiner

ELECTRIC FIREPLACE WITH LIGHT RANDOMIZER, FILTER AND DIFFUSER SCREEN

This application claims the benefit of U.S. Provisional Application No. 60/115,918, entitled Electric Fireplace, filed Jan. 14, 1999; and U.S. Provisional Application No. 60/125,637, entitled Electric Fireplace, filed Mar. 22, 1999.

BACKGROUND OF THE INVENTION

The present invention relates to electric fireplaces. In particular, the present invention relates to an electric fireplace that simulates an actual wood-burning fireplace having flames emanating from a bed of logs and glowing embers.

Electric fireplaces of various designs have been used for many years. Electric fireplaces are ordinarily installed in locations where the appearance of a combustible fuel-burning fireplace is desired. For example, a homeowner may not be want to install a traditional wood-burning fireplace because of the cost and expense associated with such installations. An electric fireplace may provide a realistic appearing alternative at a fraction of the cost. However, the desirability of an electric fireplace greatly depends on the realism of the unit. In other words, the viability of an electric fireplace as an alternative to a combustible fuel-burning fireplace is contingent on how closely the electric fireplace can simulate the combustible fuel-burning fireplace.

Electric fireplaces may also be installed in locations where traditional combustible fuel-burning fireplaces would not fit. For example, electric fireplaces are typically not as deep as traditional fireplaces, thereby permitting installation in a greater number of applications.

The problem with previous designs of electric fireplaces is that they are not very realistic looking. There is consequently a great desire for an electric fireplace that accurately and realistically simulates a combustible fuel-burning fireplace. There is also a desire for an electric fireplace that has a minimum overall depth, thereby permitting installation in a greater number of locations and circumstances.

SUMMARY OF THE INVENTION

In preferred aspects, the present invention comprises an electric fireplace designed to simulate a combustible fuel-burning fireplace. The electric fireplace comprises a housing having a top, a bottom, a back, and two sides. A simulated firebox having a top, a bottom, a back, and two sides (formed by the sides of the housing) is positioned within the fireplace housing. The firebox contains a log and ember set having one or more artificial logs positioned above an artificial bed of embers.

The fireplace also comprises a means for illuminating the underside of at least a portion of the artificial logs and a portion of the artificial bed of embers so as to create the illusion that the artificial logs and the artificial bed of embers are glowing. In particular, a light is projected upwardly through openings in the bed of embers and on to the underside and sides of the artificial logs. Some of the light striking the underside of the artificial logs is redirected back down on to the bed of embers.

The fireplace further comprises a flame simulation assembly for generating the appearance of simulated flames emanating from the artificial logs. The flame simulation assembly comprises a light source, a light randomizer, a light filter screen, and a light diffuser screen. The light randomizer comprises a rotating hollow cylinder having openings that permit light to pass through the cylinder. The light filter screen has an opaque area and a colored translucent area through which light from the light randomizer can pass on to the back of the light diffuser screen. The light diffuser screen has a partially translucent surface on which the simulated flames are projected and are visible from the front of the fireplace.

These and other advantages, as well as the invention itself, will become apparent in the details of construction and operation as more fully described and claimed below. Moreover, it should be appreciated that several aspects of the invention can be used with other types of electric fireplaces and devices for simulating combustible fuel-burning fireplaces, stoves and appliances.

DETAILED DESCRIPTION OF THE DRAWINGS AND PREFERRED EMBODIMENTS OF THE INVENTIONS

While the present invention will find application in all types of electric fireplaces or stoves, the preferred embodiment of the invention is described in conjunction with the simulated wood-burning electric fireplace of FIGS. 1–7.

Figure 1:
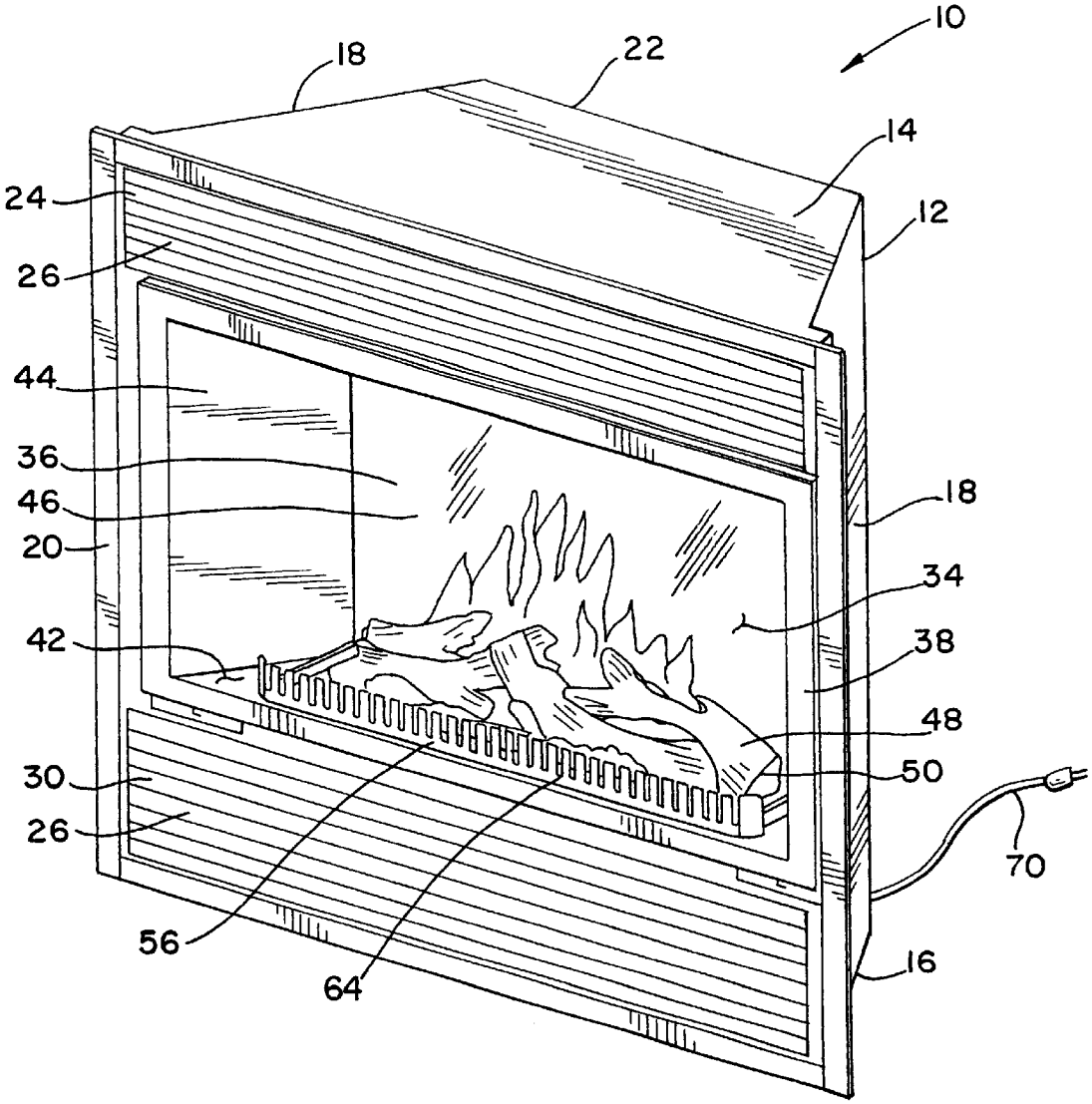
FIG. 1 is a perspective view of an embodiment of an electric fireplace of the present invention.

As best seen in FIG. 1, the electric fireplace 10 of the preferred embodiment comprises a housing 12 having a top 14, a bottom 16, two sides 18, a front 20, and a back 22. The housing 12 is manufactured from sheet metal. The sheet metal is cut, bent and joined to form the structure of the housing 12. In the preferred embodiment shown, the back 22 and two sides 18 are cut from a single piece of sheet metal and bent into shape. The combined back 22 and sides 18 of the housing is commonly referred to as the fireplace wrapper. The top 14 and bottom 16 panels are attached to the upper and lower edges, respectively, of the back 22 and sides 18 (i.e., the fireplace wrapper) to complete the basic structure of the housing 12. The edges of the individual sheet panels are typically bent to provide a small overlap at the juncture of adjoining panels. The metal panels are then joined together by either fasteners such as sheet metal screws or by welding.

The upper portion of the front 20 of the electric fireplace 10 comprises an upper louver panel 24 having a series of spaced horizontal slats or louvers 26. The upper louver panel conceals a heater assembly 28 located within the housing 12 (see FIG. 3). The slats 26 are space apart to allow room air to pass in through the upper louver panel 24 whereby it is heated by the heater assembly 28 and subsequently expelled back into the room. The slats 26 of the upper louver panel 24 are angled upwardly from front to back in such a manner as to prevent someone who is standing in front of the electric fireplace from seeing through the upper louver panel 24, thereby concealing the heater assembly 28. The upper louver panel 24 is removable to permit access to the heater assembly 28 in the event that maintenance or repair is necessary.

The lower portion of the front 20 of the electric fireplace 10 comprises a lower louver panel 30 of similar design and configuration as that of the upper louver panel 24. In other words, the lower louver panel 30 is comprised of a series of horizontal slats or louvers 26 that are spaced and angled in a similar fashion as the slats 26 of the upper louver panel 24. The lower louver panel 30 conceals the switches 32 and other devices that control the operation of the electric fireplace 10 (see FIG. 2). In the preferred embodiment, the bottom edge of lower louver panel 30 is connected to the bottom 16 of the housing 12 with one or more hinges (not shown). The hinges allow the lower louver panel 30 to be folded outwardly and downwardly to gain access to the electric fireplace controls 32. The hinges may contain springs that bias the lower louver panel 30 in the vertical or closed position.

The upper and lower louver panels, 24 and 30, are also designed and configured to simulate a concealed heat exchanger plenum arrangement of the type often incorporated in combustible fuel-burning fireplaces. For example, natural gas fireplaces often have a series of interconnected plenums surrounding the firebox that form a convection air passage around the firebox. Room air is typically drawn into and expelled out from the plenum arrangement by passing through louver panels above and below the firebox. The louver panels of the preferred embodiment are designed and configured to suggest the presence of a heat exchange plenum arrangement, thereby increasing the realism of the electric fireplace.

The front 20 of the electric fireplace 10 also comprises a transparent viewing panel 34. The viewing panel 34 is positioned between the upper and lower louver panels, 24 and 30, and permits viewing of the simulated firebox 36. The viewing panel 34 is supported by a doorframe 38 and includes hardware (not shown) designed to simulate a glass door assembly of the type typically used to enclose the firebox of a combustible fuel-burning fireplace. The viewing panel 34 may be either clear or tinted depending on the desired aesthetic appearance of the fireplace. Tinting of the viewing panel 34 may increase the realism of the fireplace by inhibiting the viewer's ability to discern the artificial components that have been used to create the illusion of a real wood-burning fire. In the preferred embodiment shown, the viewing panel 34 is comprised of clear glass. However, any transparent material can be utilized. for the viewing panel 34. For example, clear or tinted acrylic could be used in lieu of glass. The glass panel may also be omitted. The glass panel is removable to permit cleaning, maintenance or repair of components within the firebox 36.

Figure 2:
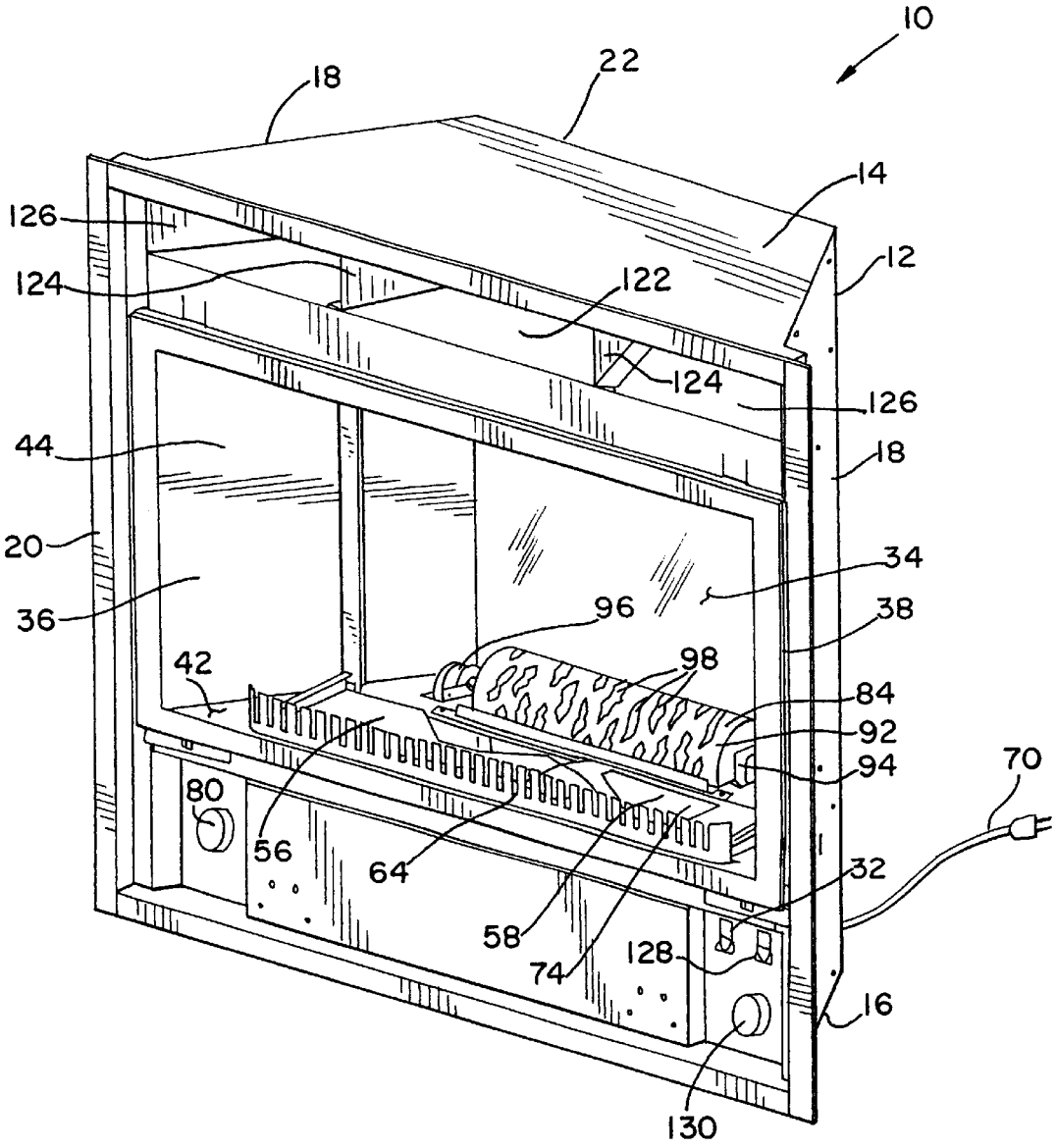
FIG. 2 is a perspective view of a partially disassembled electric fireplace depicted in FIG. 1. In this view, the upper and lower louver panels, the artificial log and ember set, the light diffuser screen, the light filter screen, and the reflective panel have been removed.
Figure 3:
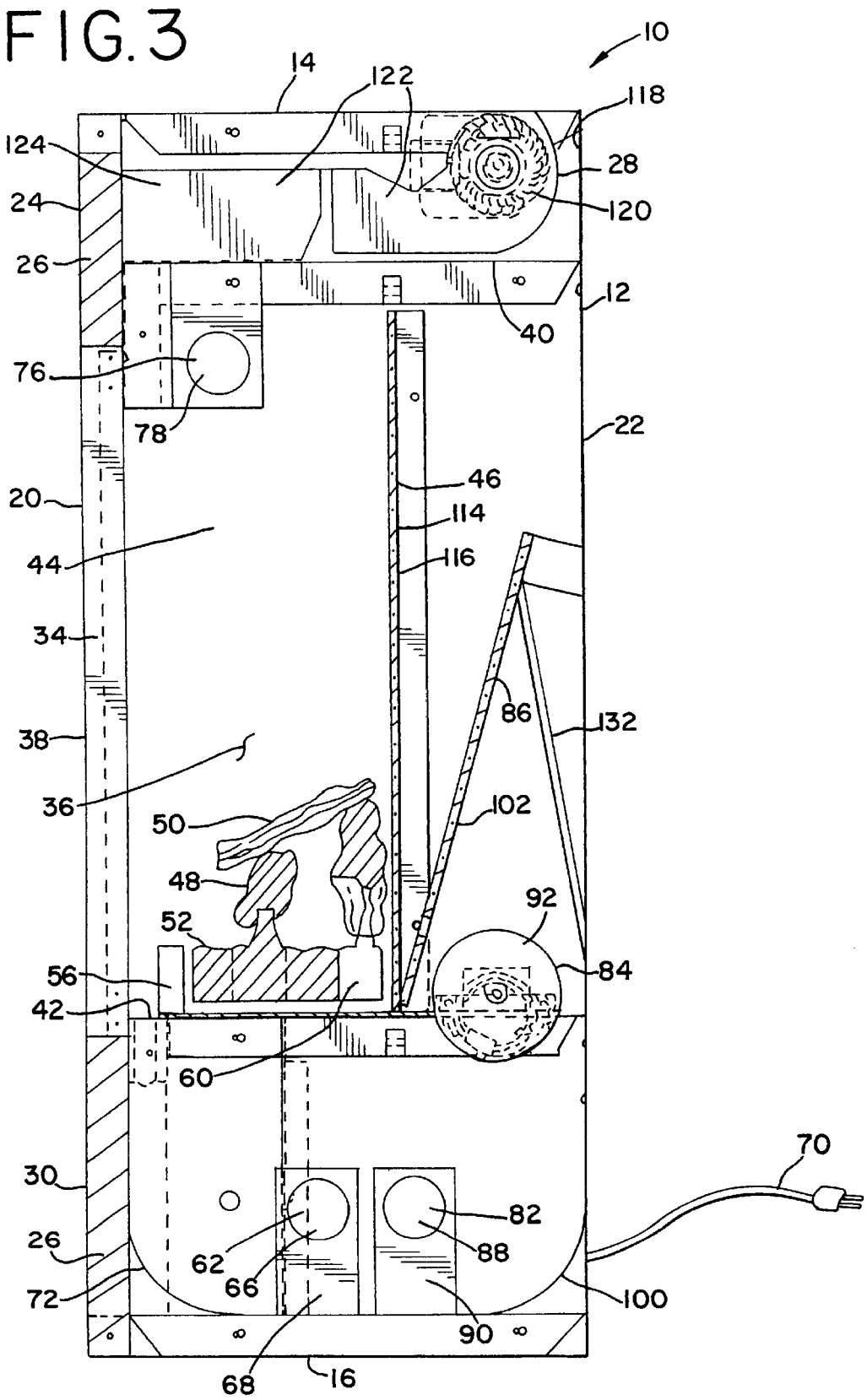
FIG. 3 is a right side cross-sectional view of the electric fireplace depicted in FIG. 1.

As described above, the viewing panel 34 permits viewing of the simulated firebox 36. As best seen in FIG. 3, the firebox 36 is positioned within the housing 12 of the electric fireplace 10 and comprises a top 40, a bottom 42, and two sides 44. A light diffuser screen 46 defines the back of the firebox 36. In the preferred embodiment shown, the firebox 36 extends from approximately the top edge of the lower louver panel 30 to above the bottom edge of the upper louver panel 24. The top 40 and bottom 42 of the firebox 36 is bounded by horizontal metal panels having outer dimensions approximately the same as the outer dimensions of the top 14 and bottom 16 of the electric fireplace 10. The top and bottom panels, 40 and 42, are attached or fastened to the interior surface of the back 22 and two sides 18 of the fireplace housing 12. As will be discussed in greater detail below, the top and bottom panels, 40 and 42, of the firebox 36 support various components of the electric fireplace 10. As best seen in FIG. 2, the fireplace housing sides 18 of the preferred embodiment define the sides 44 of the simulated firebox 36. The firebox sides 44 may be painted to appear like firebrick, which is typically used to line the firebox of combustible fuel-burning fireplaces. Alternatively, ceramic fiber refractory panels (not shown) that have been shaped and colored to look like firebrick can be attached to the interior surface of the housing to form a realistic appearing firebox. The manufacturing process for vacuum forming and coloring ceramic fiber refractory panels is well known in the art. Other materials can also be used to manufacture the artificial refractory panels.

Figure 4:
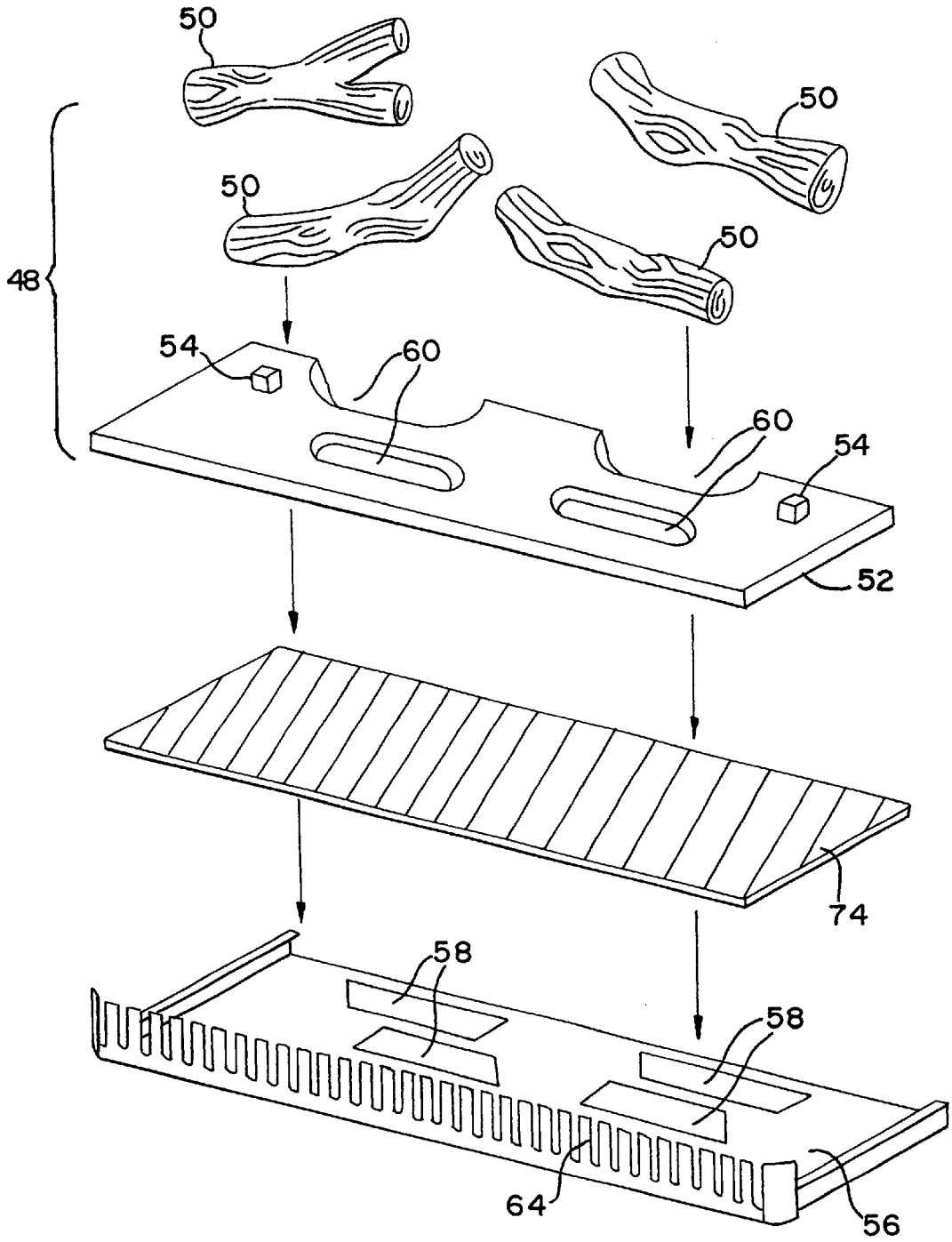
FIG. 4 is an exploded view of the artificial log and ember set, the translucent colored panel, and the grate and ember support.

An artificial log and ember set 48 is positioned in the bottom of the simulated firebox 36. As best seen in FIG. 4, the log and ember set 48 comprises one or more artificial logs 50 supported by an ember bed 52. In the preferred embodiment shown, the logs 50 and the ember bed 52 are molded from ceramic fiber by a vacuum forming process that is well known in the art. The logs 50 are shaped and colored to simulate the appearance of actual logs of any type. The ember bed 52 is shaped and colored to simulate the appearance of burnt and/or burning coals or embers.

Other materials can also be used to manufacture the artificial logs 50 and the embers 52. For example, these components can be molded from concrete, which provides for greater detail than can be achieved by using ceramic fiber. However, concrete is much heavier and is prone to breakage if accidentally dropped. The artificial logs 50 and embers 52 can also be made from other materials such as plastic, although plastic is not as realistic looking as either ceramic fiber or concrete.

In the preferred embodiment shown, the artificial logs 50 sit on top of the ember bed 52. As best seen in FIG. 4, several locator pins 54 project upwardly from the top of the ember bed 52. These locator pins 54 coincide with indentations (not shown) in the bottom of the logs 50 and assist in the proper alignment of the logs 50 on top of the ember bed 52. Alternatively, some or all of the logs 50 can be supported by brackets attached to the interior of the firebox 36. As will be explained below, proper alignment of the logs 50 on top of the ember bed 52 is necessary to create the appearance of an actual fire burning inside the firebox 36 of the fireplace 10.

The ember bed 52 is positioned on top of a metal grate and ember support 56, which is in turn supported by the bottom panel 42 of the firebox 36 (see FIG. 3). The grate and ember support 56 has one or more openings or apertures 58 that coincide with openings or apertures 60 in the ember bed 52. These openings, 58 and 60, allow light provided by a light source 62 beneath the firebox 36 to pass up through the ember bed 52 so as to illuminate the underside of certain portions of the artificial logs 50. Some of the light that illuminates the underside of the artificial logs 50 is redirected downwardly and back on to upper side of the ember bed 52. The illumination of the artificial logs 50 and the ember bed 52 creates the appearance that the logs 50 and the ember bed 52 are glowing, thereby simulating an actual wood-burning fire above a bed of burning coals or embers. Of course, the number and configuration of the apertures, 58 and 60, depends on the positioning of the artificial logs 50 and the aesthetic effect desired.

The front edge 64 of the grate and ember support 56 projects upwardly from the bottom panel 42 of the firebox 36 to prevent light from leaking or spilling out from the underside of the ember bed 52, thereby destroying the illusion of an actual wood-burning fireplace. The front edge 64 of the grate and ember support 56 is also shaped to resemble the type of grate often used in actual wood-burning fireplaces.

As best seen in FIG. 3, the light source 62 for illumination of the artificial log and ember set is provided by one or more 60 watt incandescent light bulbs 66 located beneath the bottom panel 42 of the firebox 36. Brackets 68 attached to the bottom 16 of the fireplace housing 12 support the light bulbs 66. The light bulbs 66 are connected to an electric power source 70 and to an on/off rocker switch 32 located on the front 20 of the fireplace housing 12 behind the lower louver panel 30 (see FIG. 2). A dimmer control (not shown) can also be provided to permit the viewer to adjust the degree of illumination. The electrical wiring (not shown) necessary to connect these components together is well known in the art.

A piece of reflective material 72, such as reflective or metalized plastic (such as Mylar™), is positioned beneath and in front of the light bulbs 66 to reflect additional light up through the ember bed 52. As best seen in FIG. 3, the reflective material 72 has been curved to increase the total amount of reflected light. The reflective material 72 also increases the area of the artificial log 50 underside that is illuminated by changing the point and angle of the light source 62. As best seen in FIG. 4, a translucent colored panel 74 positioned between the ember bed 52 and the grate and ember support 56 changes the color and intensity of the light source 62. In the preferred embodiment shown, a red/orange panel of translucent plastic film is utilized to change the color of the incandescent light bulbs 66 to a color that simulates glowing embers.

An additional source of light 76 is provided to illuminate the upper side of the artificial log and ember set 48. As best seen in FIG. 3, a 60 watt incandescent light bulb 78 is mounted to the underside of the top panel 40 of the firebox 36. The light bulb 78 is positioned behind the upper louver panel 24 so that it is generally not visible by a viewer standing or sitting in front of the electric fireplace 10. The light bulb 78 is positioned near the front 20 of the fireplace 10 so as to illuminate the front and upper portions of the artificial logs 50 and the ember bed 52. The light bulb 78 also provides illumination of the firebox side walls 44. The light bulb 78 is connected to an electric power source 70 and to an optional dimmer control 80 on the front 22 of the fireplace housing 22 behind the lower louver panel 30 (see FIG. 2). The dimmer control 80 is provided to permit the viewer to adjust the degree of illumination inside the firebox 36. The electrical wiring (not shown) necessary to connect these components together is well known in the art.

A light diffuser screen 46 is positioned at the back of the simulated firebox 36. The light diffuser screen 46 forms part of the flame simulation assembly, the function of which is to create the appearance of realistic looking flames arising or emanating from the artificial log and ember set 48. In addition to the light diffuser screen 46, the flame simulation assembly comprises a light source 82, a light randomizer 84, a reflective panel 132, and a light filter screen 86.

The light source 82 for the flame simulation assembly is provided by one or more 60 watt incandescent bulbs 88 located beneath the bottom panel 42 of the firebox 36. Alternatively, the flame simulation assembly could utilize light from the incandescent bulbs 66 that provide light for the illumination of the artificial log and ember set 48. Brackets 90 attached to the bottom 16 of the fireplace housing 12 support the light bulbs 88. The light bulbs 88 are connected to an electric power source 70 and to an on/off rocker switch 32 located on the front 20 of the fireplace housing 12 behind the lower louver panel 30 (see FIG. 2). A dimmer control (not shown) can also be provided to permit the viewer to adjust the degree of illumination. In the preferred embodiment shown, the light bulbs 88 are turned on and off by the same on/off rocker switch 32 that is used to turn on and off the light bulbs 66 which illuminate the underside of the artificial logs 50 and the ember bed 52. The electrical wiring (not shown) necessary to connect these components together is well known in the art.

Figure 5:
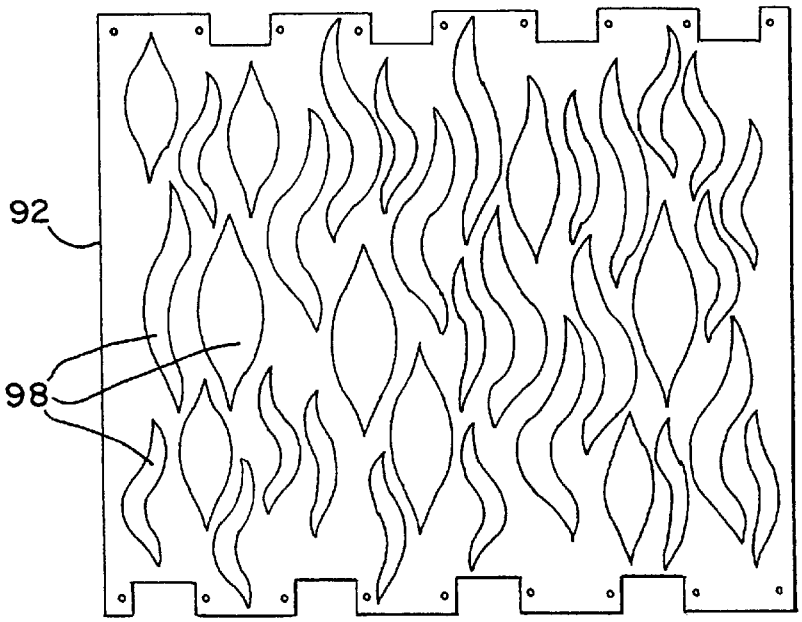
FIG. 5 is a view of a first embodiment of the patterned sheet metal that is to be rolled to form the light randomizer cylinder.
Figure 6:
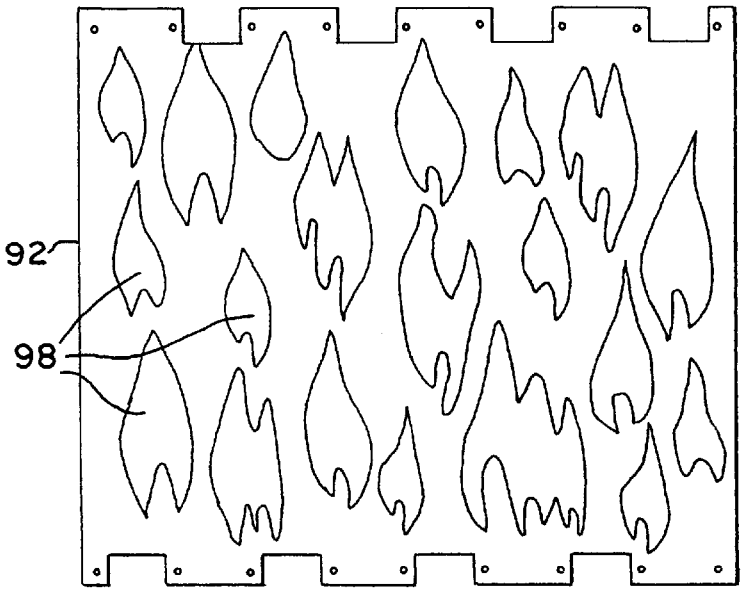
FIG. 6 is a view of a second embodiment of the patterned sheet metal that is to be rolled to form the light randomizer cylinder.

The light from the incandescent bulbs 88 is directed upwardly through the light randomizer 84. The light randomizer 84 comprises a hollow cylinder or tube 92 positioned along the back 22 of the fireplace housing 12. The cylinder 92 is made from a flat sheet of metal (as shown in FIGS. 5 and 6) which has been rolled to form a tube. The cylinder 92 can also comprise molded or formed plastic. As best seen in FIGS. 2 and 3, the ends of the cylinder 92 are rotatably connected to brackets 94 attached to either the bottom panel 42 of the firebox 36 or to the back 22 of the fireplace housing 12. The cylinder 92 is rotated about its central axis by a geared electric motor 96. The direction of rotation of the cylinder 92 is preferably clockwise when viewed from the right side (i.e., the top of the cylinder 92 moves toward the back 22 of the fireplace 10). The electric motor 96 is connected to a source of electric power 70 and to an on/off rocker switch 32 located on the front 20 of the fireplace housing 12 behind the lower louver panel 30. The electrical wiring (not shown) necessary to connect these components together is well known in the art. In the preferred embodiment shown, the electric motor 96 is turned on an off by the same on/off rocker switch 32 that is used to turn on and off the incandescent light bulbs, 66 and 88, in the bottom of the fireplace 10. The rotational speed of the cylinder 92 can also be controlled or adjusted by a variable speed control (not shown) located on the front of the fireplace housing.

The surface of the cylinder 92 has numerous openings 98 to permit light from the incandescent bulbs 88 to pass through the cylinder 92. In particular, these openings 98 are arranged so that only a certain portion of the light from the light bulbs 88 will ultimately pass through the cylinder 92 and be projected on to the back of the light diffuser screen 46. As the cylinder 92 rotates, the position, shape, and intensity of the light passing through the cylinder 92 will change. Moreover, the direction of rotation causes the changing light patterns to generally move upwardly along the back of the light diffuser screen 46. The shape of the openings 98 in the surface of the cylinder 92 will also affect the shape of the simulated flames. For example, the pattern for the cylinder openings 98 shown in FIG. 5 creates a series of flames that appear to dance or move from side to side as the cylinder 92 is rotated. The pattern for the cylinder openings 98 shown in FIG. 6, on the other hand, creates a series of flames that appear to change in height as the cylinder 92 is rotated. Any combination of shapes, sizes and numbers of openings 98 can be used depending on the nature and shape of the simulated flame that is desired.

The cylinder 92 of the preferred embodiment is manufactured from polished aluminum, but can be made from any reflective material such as stainless steel or plastic. The reflective surface of the material should be on the interior surface of the cylinder 92 so that the light that passes through the openings 98 on the underside of the cylinder 92 is reflected and redirected out through the openings 98 on the topside of the cylinder 92. If a reflective surface is not utilized, then the light emanating from the topside of the cylinder 92 is limited to the light that passes directly through the cylinder 92 (i.e., where openings 98 on the top and bottom of the cylinder 92 are aligned with the light source 82). Of course, the direction and intensity of the light source 82 can also be altered or supplemented by the use of a reflective surface 100, such as reflective or metalized plastic (such as Mylar™), positioned adjacent to the incandescent light bulbs 88. In the preferred embodiment shown, a curved sheet of reflective plastic 100 is positioned along the back 22 of the fireplace housing 12 to redirect light from the incandescent bulbs 88 up through the cylinder 92 and on to the back of the light diffuser screen 46.

Figure 7:
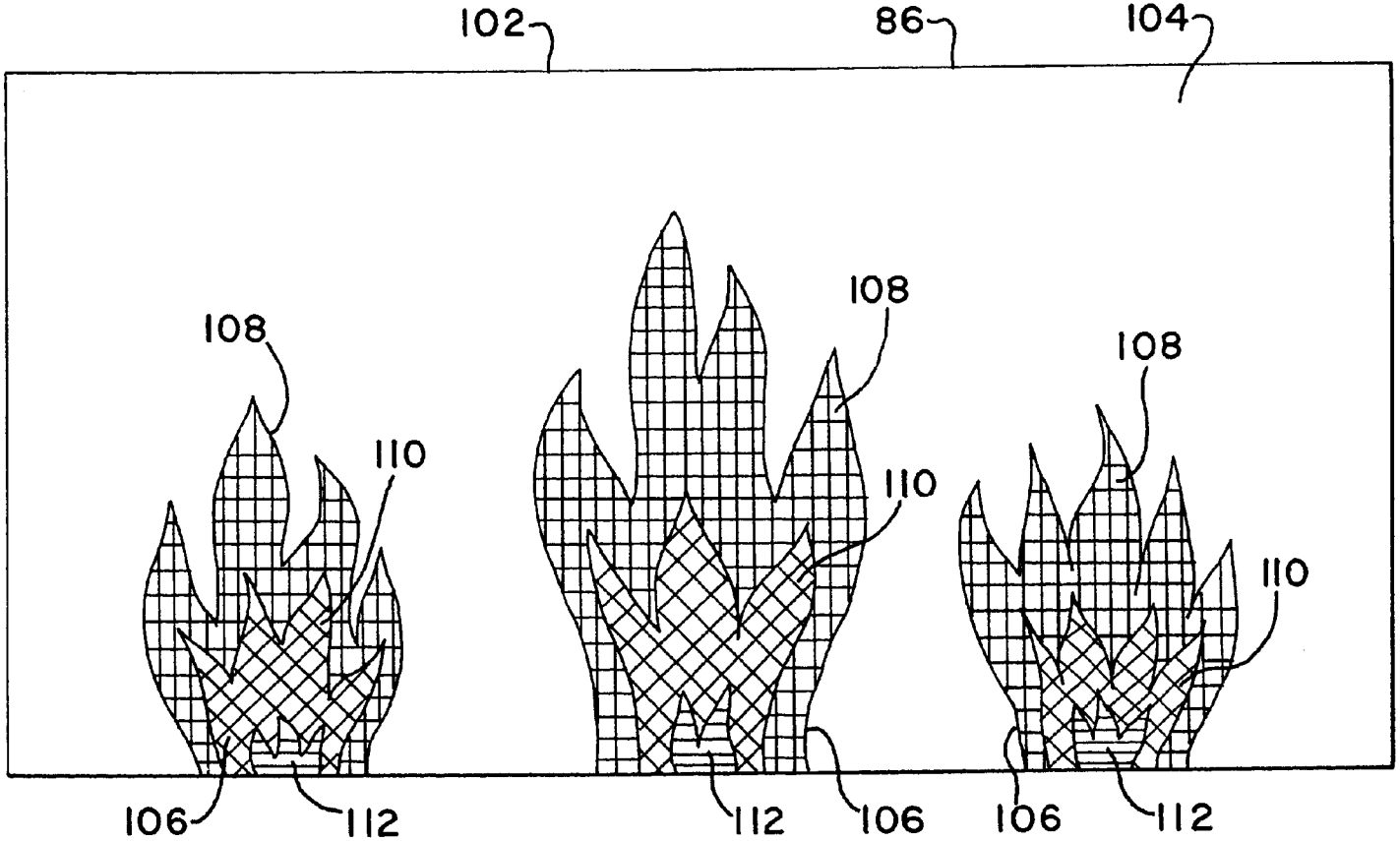
FIG. 7 is a view of the light filter screen.

The light emanating from the light randomizer 84 is directed upwardly on to the back of the light diffuser screen 46. As best seen in FIG. 3, a light filter screen 86 is positioned between the light randomizer 84 and light diffuser screen 46. The light filter screen 86 extends across the width of the fireplace 10 and limits the overall area on the back of the light diffuser screen 46 that receives light from the light randomizer 84. As best seen in FIG. 7, the light filter screen 86 is comprised of a translucent panel 102 made from polycarbonate. In the preferred embodiment shown, a portion of the panel 102 has been rendered opaque by the application of black paint 104. Alternatively, a separate opaque panel having cutout areas can be placed against the translucent panel 102 to render portions of the translucent panel 102 opaque. The translucent area 106 of the light filter screen 86 necessarily limits the area of light from the light randomizer 84 that strikes the back of the light diffuser screen 46.

The light filter screen 86 also changes the color of the light striking the back of the light diffuser screen 46. As best seen in FIG. 7, the translucent area 106 of the light filter screen 86 has been silk screened with translucent paint of various colors. In the preferred embodiment shown, the translucent area 106 of the light filter screen 86 comprises three separate flame-shaped areas. Moreover, areas of the translucent area 106 of the light filter screen 86 are colored with translucent yellow 108, translucent red/orange 110, and translucent blue 112 paint. The colors are selected to simulate the color of actual flames emanating from wood-burning fires. Of course, any combination of colors can be utilized depending on the aesthetic quality of the simulated flame desired.

As shown in FIG. 3 of the preferred embodiment, a reflective panel 132 is utilized to further enhance the aesthetic quality of the light striking the back of the light diffuser screen 46. The reflective panel 132 is positioned above and rearwardly of the light randomizer 84, and is angled so as to reflect light emanating from the cylinder 92 through the light filter screen 86 and onto the light diffuser screen 46. The reflective panel 132 has the effect of multiplying the number of light images created by the light randomizer 84 that strike the back of the light diffuser screen 46. The number of light images can be further multiplied by coating the back of the light filter screen 86 with a partially reflective material. In the preferred embodiment shown, the light filter screen 86 is made from polycarbonate, which has a naturally reflective surface. The partially reflective surface will cause a portion of the light striking the back of the light filter screen 86 to be reflected rearwardly toward the reflective panel 132, where it will again be reflected forwardly toward and through the light filter screen 86 and onto the light diffuser screen 46. In addition to increasing the number of light images striking the light diffuser screen 46, the reflective panel 132, in combination with the partially reflective surface of the back of the light filter screen 86, will make the light images striking the light diffuser screen 46 appear to be moving in opposite vertical directions (i.e., a "mirror" effect), further randomizing the nature of the simulated flames.

The light diffuser screen 46 provides the surface on which the simulated flames are projected. The light diffuser screen 46 is translucent or partially transparent so that the simulated flames are visible from the front of the fireplace 10. The light diffuser screen 46 is positioned against the back of the log and ember set 48 so that the simulated flames appear to be emanating from the artificial logs 50. The light diffuser screen 46 of the preferred embodiment is comprised of a bronze tinted transparent acrylic panel 114 that has been treated or combined with a diffusing material such as a plastic Mylar™ sheet 116. The diffusing material 116 provides the surface on which the projected flames become visible. The bronze tint on the acrylic panel 114 softens the edges of the simulated flames so as to enhance the realism of the fireplace.

The front surface of the light diffuser screen 46 can also be mirrored so as to reflect an image of the back of the log and ember set 48. This would increase the apparent depth of the simulated firebox 36, as well as making the artificial flames appear to emanate from the middle of the logs 50. Of course, the mirrored surface must still be partially transparent so that the simulated flames are visible from the front of the fireplace 10.

The flame simulation assembly is compact, thereby reducing the overall depth of the electric fireplace 10. This allows the fireplace 10 to be installed in locations that may not otherwise permit installation of a combustible fuel-burning fireplace or an electric fireplace of different design. In the preferred embodiment shown, the depth of the flame simulation assembly (i.e., the distance between the light diffuser screen and the back of the housing) is approximately 4 inches, and the overall depth of the electric fireplace is approximately 11–12 inches.

The preferred embodiment of the electric fireplace 10 includes a heater assembly 28 located in the top of the housing 12 above the top panel 40 of the firebox 36. The heater assembly 28 comprises a heating element 118 connected to tangential blower fan 120. As best seen in FIGS. 2 and 3, the heated air from the heater assembly 28 is directed out through the front of the fireplace by an air outlet duct or passageway 122. The air outlet duct 122 is formed by a series of baffles 124 attached to the top panel 40 of the firebox 36 that direct the heated air out through the upper louver panel 24. The heater assembly 28 draws the air to be heated from the room in which the fireplace 10 is situated. The room air to be heated is drawn in through the upper louver panel 24 through passageways 126 on either side of the air outlet duct 122. The heater assembly 28 is connected to a source of electric power 70 and is controlled by an on/off rocker switch 128 on the front 22 of the fireplace located behind the lower louver panel 30. The heater assembly may 28 also be connected to a thermostatically controlled device 130 which automatically turns the heater assembly 28 on or off at pre-determined temperature settings.

It should be appreciated that the apparatus of the present invention is capable of being incorporated in the form of a variety of embodiments, only a few of which have been illustrated and described above. For example, aspects of the present invention could be incorporated in an electric fireplace designed to simulate a coal burning hearth of the type commonly used in Europe. Likewise, aspects of the present invention can be incorporated in other types of heating appliances such as electric simulated freestanding wood or coal burning stoves. The invention may be embodied in other forms without departing from its spirit or essential characteristics. The described embodiments are to be considered in all respects only as illustrative and not restrictive, and the scope of the invention is, therefore, indicated by the appended claims rather than by the foregoing description. All changes which come within the meaning and range of equivalency of the claims are to be embraced within their scope.

We claim:

1. An electric fireplace designed to simulate a combustible fuel-burning fireplace comprising:

a) a housing having a top, a bottom, a back, and two sides;

b) a simulated firebox within the housing;

c) a log and ember set with the firebox, said log and ember set comprising one or more artificial logs positioned above an artificial bed of embers, said artificial logs having an underside surface that is spaced apart from an upper surface of the artificial bed of embers, wherein said log and ember set comprises a plurality of holes in said artificial bed of embers;

d) a light source positioned so as to permit light from said light source to pass through said holes for illuminating at least a portion of the underside surface of the artificial logs and a portion of the upper surface of the artificial bed of embers so as to create the illusion that the artificial logs and the artificial bed of embers are burning; and e) a flame simulation assembly for generating the appearance of simulated flames emanating from the artificial logs, said flame simulation assembly comprising a light randomizer, a light filter screen, and a light diffuser screen, said light randomizer comprising a rotating hollow cylinder having openings that permit light to pass through the cylinder, said light filter screen having opaque areas and colored translucent areas, said light diffuser screen having a partially translucent surface on which simulated flames are projected and are visible from the front of the fireplace.

2. The electric fireplace of claim 1 further comprising a translucent colored panel positioned between said light source and said log and ember set.

3. The electric fireplace of claim 1 wherein said one or more artificial logs and said artificial bed of embers each comprise a ceramic refractory material.

4. The electric fireplace of claim 1 wherein said light randomizer further comprises an electric motor for rotating said rotating hollow cylinder.

5. The electric fireplace of claim 1 further comprising a heater assembly, said heater assembly comprising a blower and a heating element.

6. The electric fireplace of claim 1 further comprising a reflective panel adjacent to said light randomizer, said reflective panel positioned so as to reflect light received from said rotating hollow cylinder through said light filter screen and onto said light diffuser screen.

7. The electric fireplace of claim 1 wherein the colored translucent areas of said light filter screen are shaped and colored so as to produce simulated flames on said light diffuser screen.

8. The electric fireplace of claim 1 wherein said flame simulation assembly comprises a second light source for generating said simulated flames.

9. An electric fireplace designed to simulate a combustible fuel-burning fireplace comprising:

a) a housing having a top, a bottom, a back, and two sides;

b) a simulated firebox within the housing, said firebox having a top, a bottom, a back, and two sides;

c) a log and ember set within the firebox, said log and ember set comprising one or more artificial logs positioned above an artificial bed of embers, said artificial logs having an underside surface that is spaced apart from an upper surface of the artificial bed of embers;

d) a first light source for illuminating at least a portion of the underside surface of the artificial logs and a portion of the upper surface of the artificial bed of embers so as to create the illusion that the artificial logs and the artificial bed of embers are burning, said first light source being positioned beneath said firebox so as to project light up through a plurality of holes in said artificial bed of embers;

e) a colored translucent panel positioned between said first light source and said log and ember set;

f) a flame simulation assembly for generating the appearance of simulated flames emanating from the artificial logs, said flame simulation assembly comprising a second light source, a light randomizer, a light filter screen, and a light diffuser screen, said light filter screen being positioned between said light randomizer and said light diffuser screen, said light randomizer comprising a rotating hollow cylinder having openings that permit light emanating from said second light source to pass through the cylinder and towards said light filter screen, said light filter screen having opaque areas and colored translucent areas, said light diffuser screen having a partially translucent surface onto which light emanating from said light randomizer and passing through said light filter screen is projected so as to simulate flames that are visible from the front of the fireplace.

10. The electric fireplace of claim 9 further comprising a heater assembly, said heater assembly comprising a blower and a heating element.

11. The electric fireplace of claim 9 further comprising a third light source for illuminating at least a portion of an upwardly facing surface of said log and ember set, said third source of light being located near the top of said firebox.

12. A simulated ember bed for use with an artificial log set, said simulated ember bed comprising:

a) an artificial bed of embers positioned beneath said artificial log set; and d) a light source for illuminating at least a portion of an exterior surface of the artificial log set and a portion of an upper surface of the artificial bed of embers so as to create the illusion that the artificial embers are glowing beneath said artificial log set, wherein said artificial bed of embers comprises a plurality of holes positioned so as to permit light from said light source to pass through said bed of embers and illuminate the exterior surface of the artificial log set and the upper surface of the bed of embers.

13. The simulated ember bed of claim 12 further comprising a colored translucent panel positioned between said light source and said artificial bed of embers.

14. An electric fireplace comprising:

a) a housing having a top, a bottom, a back, and two sides;

b) a simulated firebox within the housing;

c) one or more artificial logs inside said firebox;

d) a light source beneath said firebox, said light source positioned so as to illuminate at least a portion of an exterior surface of said one or more artificial logs;

e) a flame simulation assembly comprising a light randomizer and a light diffuser screen, said light diffuser screen having a partially translucent surface; and f) an artificial ember bed positioned beneath said one or more artificial logs, wherein said light source is positioned so as to illuminate at least a portion of an upper surface of said artificial ember bed, and wherein said artificial ember bed comprises a plurality of holes positioned so as to permit light from said light source to illuminate at least a portion of the exterior surface of the artificial logs and a portion of the upper surface of the artificial ember bed.

15. The electric fireplace of claim 14 further comprising a translucent colored panel positioned between said light source and said one or more artificial logs.

16. The electric fireplace of claim 14 wherein said one or more artificial logs and said artificial ember bed each comprise a ceramic refractory material.

17. The electric fireplace of claim 14 wherein said light randomizer comprises a rotating hollow cylinder having openings that permit light to pass through the cylinder so as to project onto said light diffuser screen.

18. The electric fireplace of claim 17 wherein said light randomizer further comprises an electric motor for rotating said rotating hollow cylinder.

19. The electric fireplace of claim 17 further comprising a reflective panel adjacent to said light randomizer, said reflective panel positioned so as to reflect light passing through said rotating hollow cylinder towards said light filter screen.

20. The electric fireplace of claim 14 wherein said flame simulation assembly further comprises a light filter screen having opaque areas and colored translucent areas.

21. A simulated electric stove comprising:

a) a housing having a top, a bottom, a back, and two sides;

b) a simulated firebox within the housing;

c) a bed of artificial coals inside said firebox;

d) a light source beneath said firebox, said light source positioned so as to illuminate at least a portion of an exterior surface of said bed of artificial coals; and e) a flame simulation assembly comprising a light randomizer and a light diffuser screen, said light diffuser screen having a partially translucent surface; and f) an artificial ember bed positioned beneath said bed of artificial coals, wherein said light source is positioned so as to illuminate at least a portion of an upper surface of said artificial ember bed, and wherein said artificial ember bed comprises a plurality of holes positioned so as to permit light from said light source to illuminate at least a portion of the exterior surface of the bed of artificial coals and a portion of the upper surface of the artificial ember bed.

22. The simulated electric stove of claim 21 further comprising a translucent colored panel positioned between said light source and said bed of artificial coals.

23. The simulated electric stove of claim 21 wherein said bed of artificial coals and said artificial ember bed each comprise a ceramic refractory material.

24. The simulated electric stove of claim 21 wherein said light randomizer comprises a rotating hollow cylinder having openings that permit light to pass through the cylinder so as to project onto said light diffuser screen.

25. The simulated electric stove of claim 24 wherein said light randomizer further comprises an electric motor for rotating said rotating hollow cylinder.

26. The simulated electric stove of claim 24 further comprising a reflective panel adjacent to said light randomizer, said reflective panel positioned so as to reflect light passing through said rotating hollow cylinder towards said light filter screen.

27. The simulated electric stove of claim 21 wherein said flame simulation assembly further comprises a light filter screen having opaque areas and colored translucent areas.

* * * * *